US008182242B2

(12) United States Patent
Harrington et al.

(10) Patent No.: US 8,182,242 B2
(45) Date of Patent: May 22, 2012

(54) COMPRESSOR VIBRATION ISOLATION MOUNT AND METHOD OF USE

(75) Inventors: Steven M. Harrington, Cardiff, CA (US); Bruce K. Bridges, Cardiff, CA (US); Carl E. Tedesco, Cardiff, CA (US); Douglas D. Gaylord, San Diego, CA (US)

(73) Assignee: Chart SeQual Technologies Inc., Dover, DE (US)

( * ) Notice: Subject to any disclaimer, the term of this patent is extended or adjusted under 35 U.S.C. 154(b) by 1015 days.

(21) Appl. No.: 12/133,608

(22) Filed: Jun. 5, 2008

(65) Prior Publication Data

US 2008/0304980 A1 Dec. 11, 2008

Related U.S. Application Data

(60) Provisional application No. 60/933,661, filed on Jun. 8, 2007.

(51) Int. Cl.
*F04B 39/12* (2006.01)

(52) U.S. Cl. ..... 417/363; 248/179.1

(58) Field of Classification Search ..... 417/363
See application file for complete search history.

(56) References Cited

U.S. PATENT DOCUMENTS

| | | | | |
|---|---|---|---|---|
| 2,757,050 | A | 7/1956 | Weber et al. | |
| 2,817,974 | A * | 12/1957 | Muzzey et al. | 74/5.4 |
| 3,498,145 | A * | 3/1970 | Clark | 74/5.43 |
| 3,512,419 | A * | 5/1970 | Stiles | 74/5 F |
| 3,747,418 | A * | 7/1973 | Hoffman et al. | 74/5.43 |
| 3,765,631 | A | 10/1973 | Herbst et al. | |
| 4,010,544 | A | 3/1977 | Siman | |
| 4,627,860 | A * | 12/1986 | Rowland | 96/111 |
| 5,873,560 | A | 2/1999 | Serdar, Jr. et al. | |
| 6,143,056 | A | 11/2000 | Smolarek et al. | |
| 6,443,713 | B1 * | 9/2002 | Weiss et al. | 417/413.1 |
| 6,450,781 | B1 * | 9/2002 | Petrovich et al. | 417/350 |
| 6,666,612 | B2 | 12/2003 | Lorigny | |
| 6,691,702 | B2 | 2/2004 | Appel et al. | |

FOREIGN PATENT DOCUMENTS

WO 2006-108092 10/2006

OTHER PUBLICATIONS

International Search Report and Written Opinion from related PCT/US2008/065868 dated Oct. 13, 2008.

* cited by examiner

*Primary Examiner* — Devon C Kramer
*Assistant Examiner* — Philip Stimpert
(74) *Attorney, Agent, or Firm* — Fred C. Hernandez; Mintz, Levin, Cohn, Ferris, Glovsky and Popeo, P.C.

(57) ABSTRACT

A compressor vibration isolation mount for isolating the vibrations of a compressor from the rest of a structure includes at least one frame; and at least one gimbal coupling the compressor to the at least one frame for partial rotation about at least one primary axis of rotation.

20 Claims, 5 Drawing Sheets

COMPRESSOR VIBRATION ISOLATION MOUNT AND METHOD OF USE

CROSS-REFERENCE TO RELATED APPLICATION

The present application claims the benefit of U.S. Provisional Patent Application 60/933,661 filed Jun. 8, 2007 under 35 U.S.C. 119(e). This application is incorporated by reference herein as though set forth in full.

FIELD OF THE INVENTION

The field of this invention relates to devices and methods for isolating a compressor and reducing transmitted vibration from the compressor.

BACKGROUND OF THE INVENTION

Portable oxygen concentrators are commonly used in the home medical market to treat ambulatory patients with chronic obstructive pulmonary diseases. To make an oxygen concentrator portable, the oxygen concentrator must be as small as possible and weigh as little as possible while delivering sufficient concentrated oxygen gas flow to the ambulatory patient.

Compressors are used in oxygen concentrators to supply high-pressure feed air to a Pressure Swing Adsorption (PSA) Module or concentrator. Air compressors, especially rotary piston air compressors and diaphragm-type air compressors, produce a significant amount of vibration during use. The vibration produced by these types of compressors is primarily torsional due to the compressor motor slowing down as the air pressure builds during an upstroke of a compressor cycle and then the compressor motor speeding up as the cylinder refills. Also, if the compressor includes more than one cylinder, a torsional mode of vibration perpendicular to the motor axis may also be created by the fact that the axes of the additional cylinders are not generally in the same plane.

To isolate the compressor and reduce the transmitted vibration, low-rate springs with a large amount of travel have been used, but this increases the amount of space that the compressor installation requires to allow for the compressor to move. This larger amount of space required for the compressor isolation makes the portable oxygen concentrator larger. Also, the compressor may knock against the interior of a compressor housing, particularly when it starts, stops or is moved, which creates excessive noise and possible damage or wear to the compressor and hoses.

SUMMARY OF THE INVENTION

To solve these problems and others, an aspect of present invention involves a compressor vibration isolation mount that reduces the space required by a compressor vibration isolation system and reduces the potential for the compressor to knock against the inside of the compressor housing while it is being moved, in particular for a portable device such as, but not limited to, a portable oxygen concentrator. The compressor vibration isolation mount includes a gimbal mount to allow the compressor and motor assembly to rotate in two perpendicular axes that go substantially through the assembly center of mass. These mounts use an elastomeric material to keep the compressor from moving more than a few degrees. The elastomeric mounts get stiffer as the compressor is twisted in either axis in a nonlinear manner.

A further aspect of the invention involves a compressor vibration isolation mount for isolating the vibrations of a compressor from the rest of a structure. The compressor vibration isolation mount includes at least one frame; and at least one gimbal coupling the compressor to the at least one frame for partial rotation about at least one primary axis of rotation.

Another aspect of the invention involves a method of using a compressor vibration isolation mount including providing a compressor with the above-described compressor vibration isolation mount so that at least one gimbal couples the compressor to the at least one frame for partial rotation about at least one primary axis of rotation; and operating the compressor so that the compressor vibrates and rotates partially about at least one primary axis of rotation.

Further objects and advantages will be apparent to those skilled in the art after a review of the drawings and the detailed description of the preferred embodiments set forth below.

DETAILED DESCRIPTION OF PREFERRED EMBODIMENTS

Figure 1:
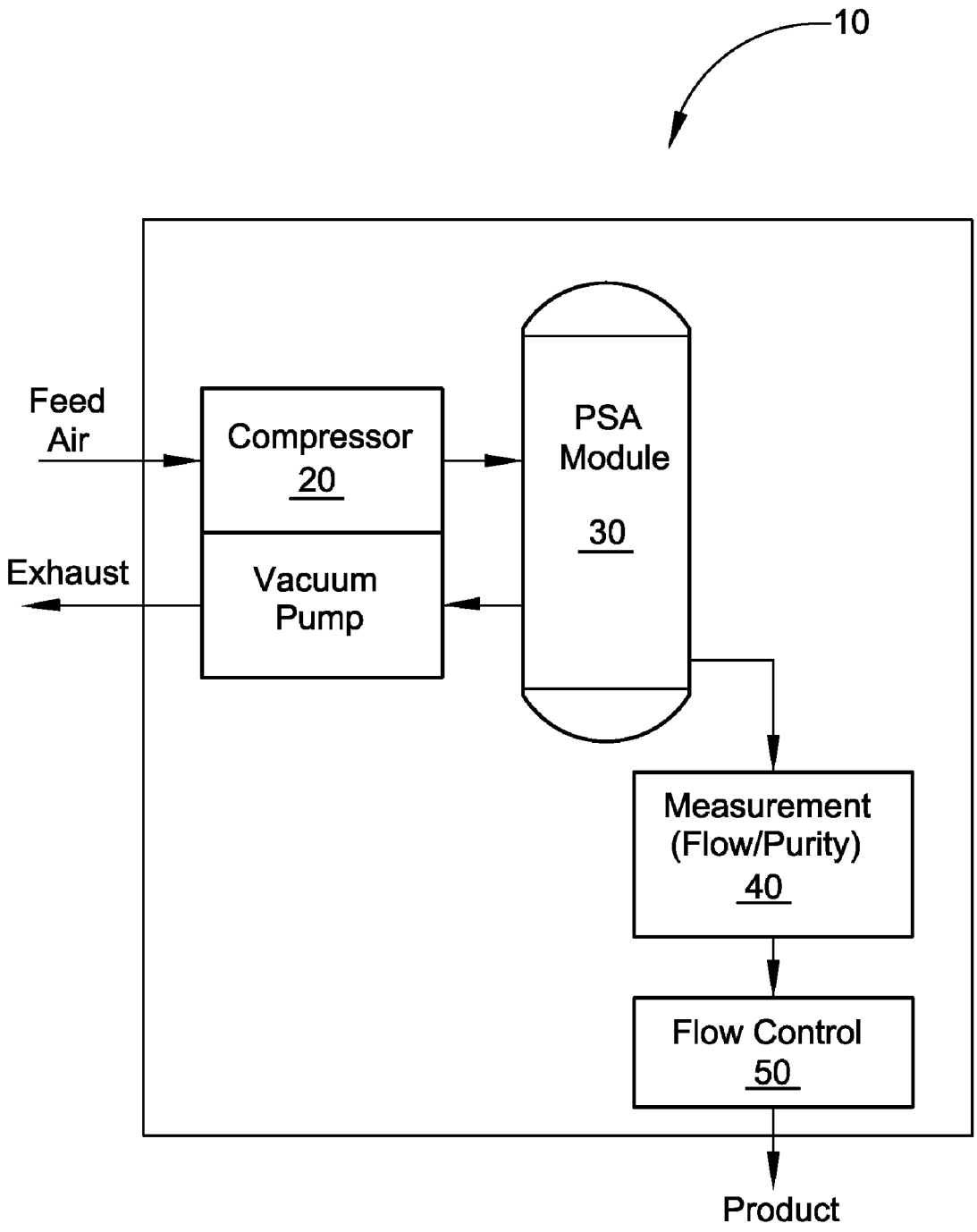
FIG. 1 is a simple schematic of an embodiment of a gas separation device, which is an exemplary system/environment for the compressor vibration isolation mount.
Figure 2:
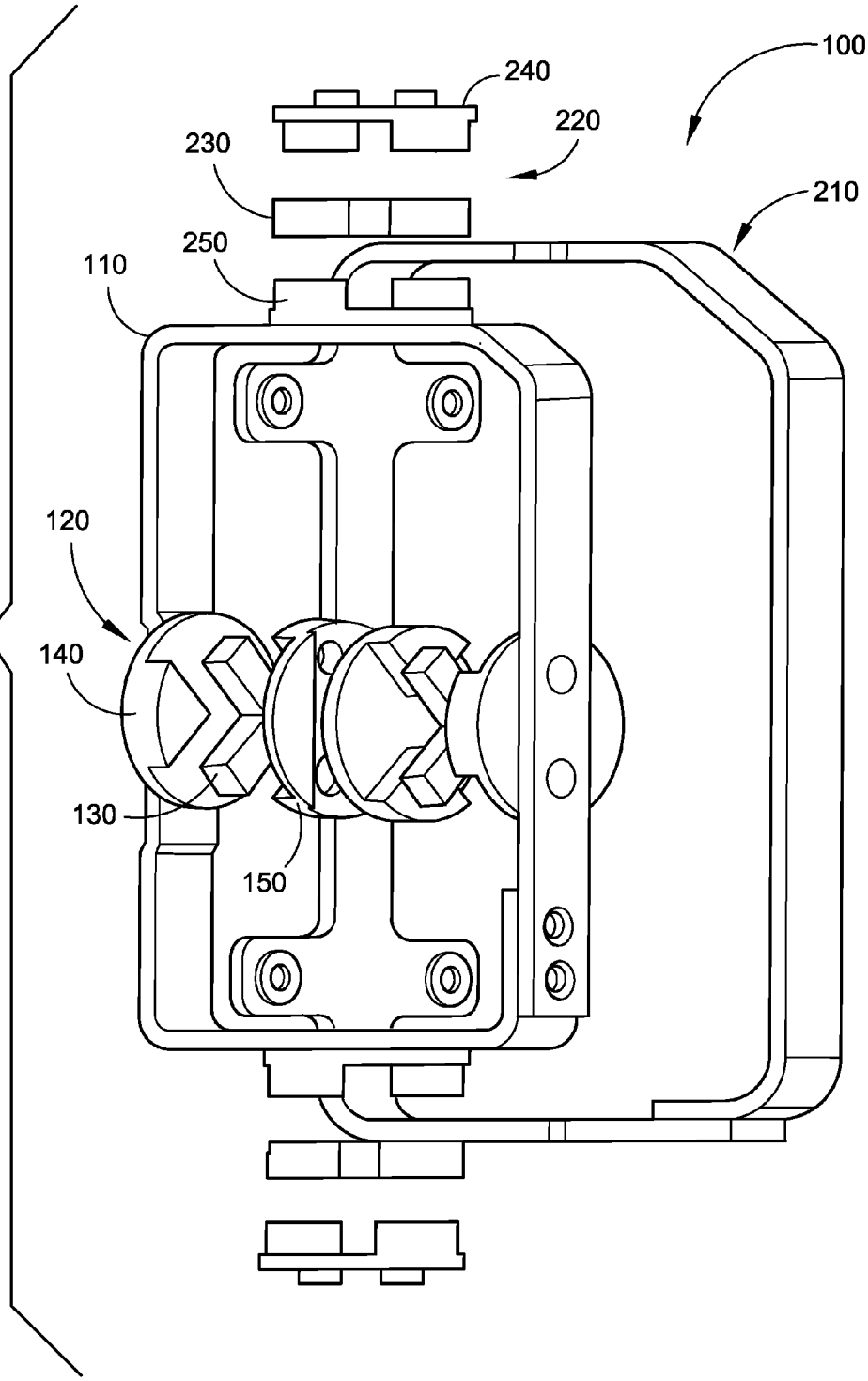
FIG. 2 is an exploded perspective view of a compressor vibration isolation mount constructed in accordance with an embodiment of the invention.
Figure 3:
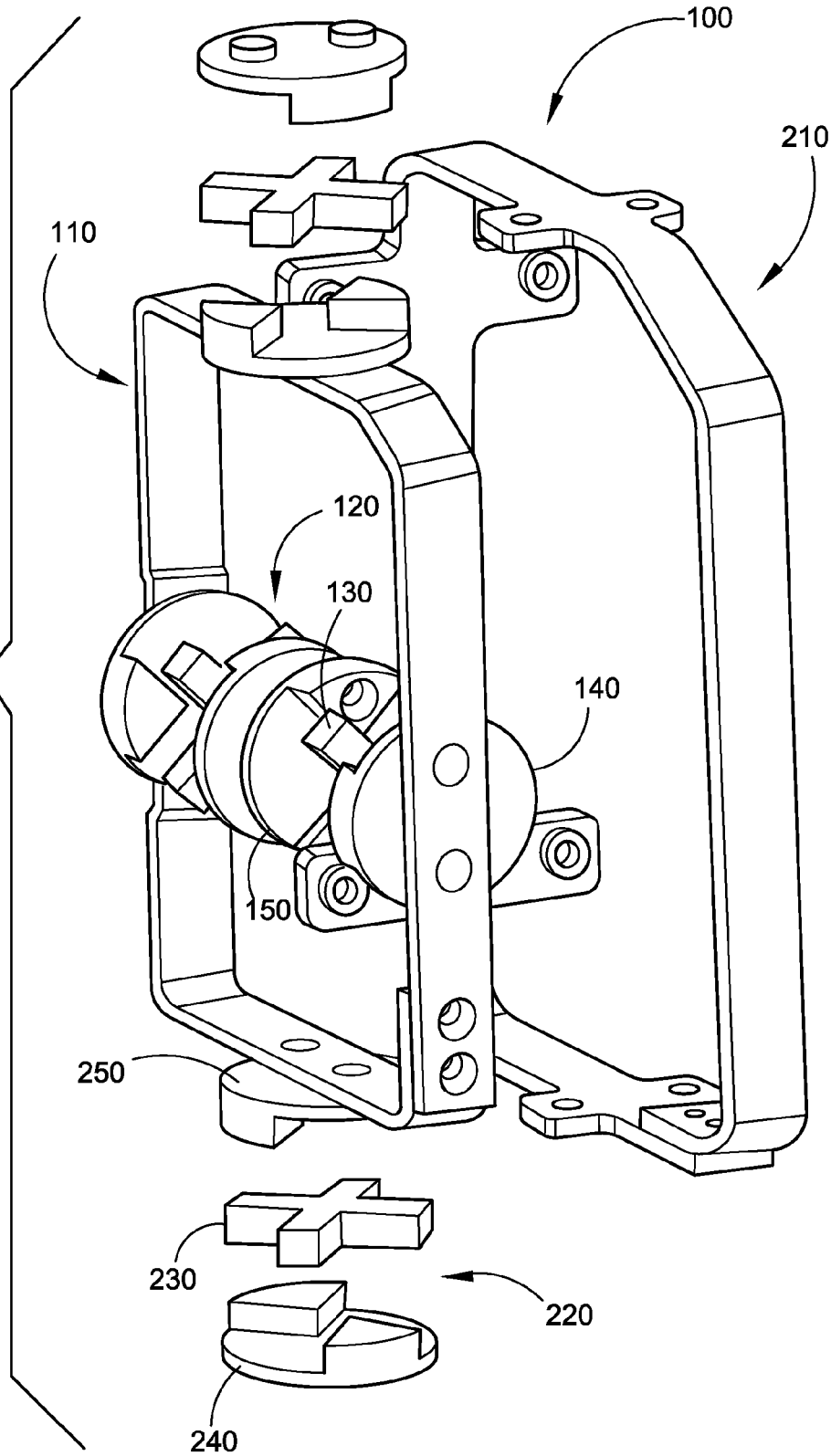
FIG. 3 is another exploded perspective view of the compressor vibration isolation mount illustrated in FIG. 2.
Figure 4:
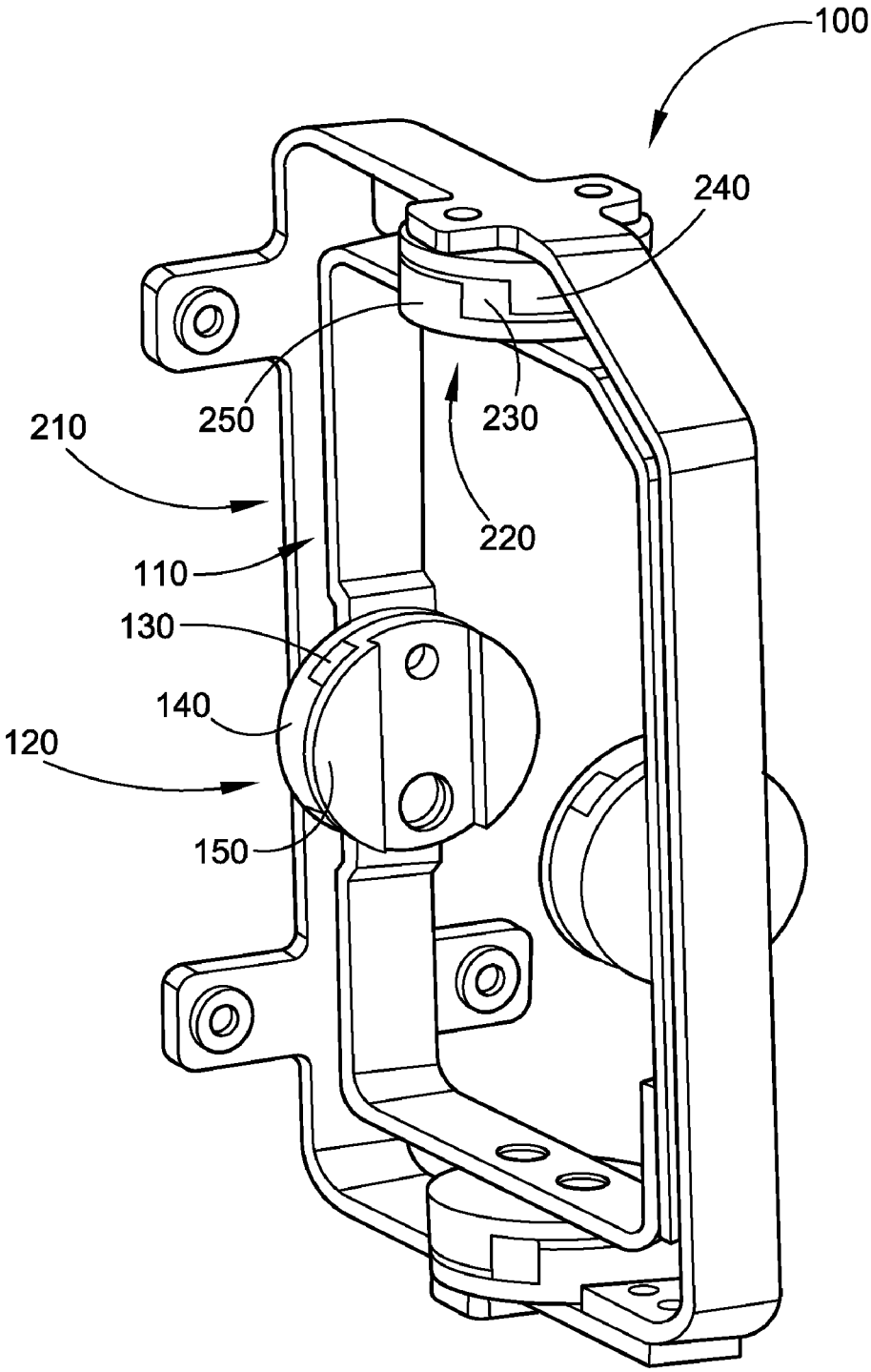
FIG. 4 is a perspective view of the compressor vibration isolation mount illustrated in FIG. 2 in an assembled condition.

With reference to FIG. 1, a gas separation device 10 constructed in accordance with an embodiment of the invention will first be described before describing an embodiment of a compressor vibration isolation mount 100. The gas separation device 10 may include a compressor 20 (e.g., rotary piston air compressor, diaphragm-type air compressor), which may be combination compressor/vacuum generator (hereinafter "compressor"), a Pressure Swing Adsorption (PSA) Module or concentrator 30, a measurement mechanism 40, and a flow control mechanism 50.

In a preferred embodiment, the gas separation device 10 is a portable oxygen concentrator weighing in the range of 2-20 pounds. An example portable oxygen concentrator system that comprises the gas separation device 10 is shown and described in U.S. Pat. No. 6,691,702, which is hereby incorporated by reference herein as though set forth in full. In particular, the portable oxygen concentrator system 100 and described with reference to FIGS. 1-16, and especially FIGS. 1, 2, 12, 15, and 16, may be used as the gas separation device 10.

In use, a feed fluid such as ambient air may be drawn into the compressor 20 and delivered under high pressure to the PSA Module 30. In a preferred embodiment, the compressor 20 is a combination compressor and vacuum pump/generator. The vacuum generator is preferably driven by the same motor as the compressor and is integrated with the compressor. The vacuum generator draws exhaust gas from the PSA module 30 to improve the recovery and productivity of the PSA module 30. The PSA module 30 separates a desired product fluid (e.g., oxygen) from the feed fluid (e.g., air) and expels exhaust fluid. Characteristics of the product fluid (e.g., flow/purity) may be measured by a measurement mechanism 40. Delivery of the product fluid may be controlled with the flow control mechanism 50.

With reference to FIGS. 2-5, an embodiment of a compressor vibration isolation mount 100 that isolates the compressor 20 and reduces the transmitted vibration from the compressor 20 will be described.

Figure 5:
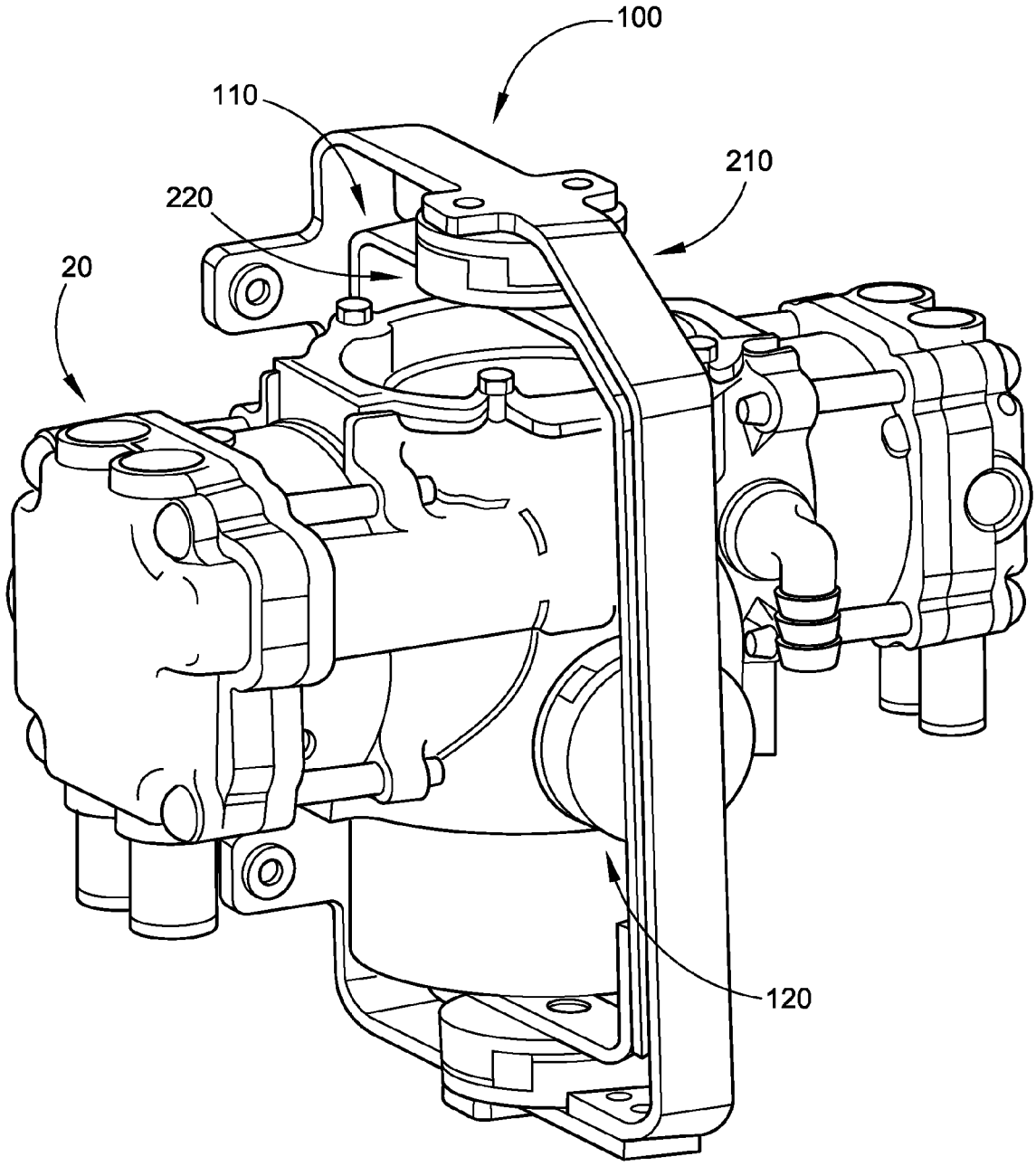
FIG. 5 is a perspective view of the compressor vibration isolation mount illustrated in FIG. 4, and shows an embodiment of a compressor carried by the compressor vibration isolation mount.

The compressor vibration isolation mount 100 includes a substantially rectangular inner frame 110 that surrounds the compressor 20 (FIG. 5). The inner frame 110 is coupled to the compressor 20 via a first pair of opposite end mounts 120. Through the two end mounts 120, the weight of the compressor 20 is carried by the compressor vibration isolation mount 100.

Each end mount 120 includes a cross-shaped member ("cross member") 130 formed of an elastomeric material (e.g., plastic, rubber), an outer/first pie-shaped wedge member 140, and an inner/second pie-shaped wedge member 150. The outer pie-shaped wedge member 140 attaches to the inner frame 110 and the inner pie-shaped wedge member 150 attaches to the compressor 20. Each pie-shaped wedge member 140, 150 includes pie-shaped wedges and recesses. The cross member 130 and the wedges/recesses of the pie-shaped wedge members 140, 150 cooperate when these pieces are put together to form a resilient coupling between the inner frame 110 and the compressor 20. The pie-shaped wedge members 140, 150 include corresponding holes for receiving fasteners used to couple the inner frame 110, end mounts 120, and compressor 20 together.

The resilient nature and configuration of the end mounts 120 allows the compressor 20 to rotate about a first axis substantially through the center of the end mounts 120 and substantially through the center of gravity of the compressor 20. The elastomeric material and configuration of the end mounts 120 keep the compressor 20 from rotating about the first axis to no more than a few degrees. In an embodiment of the invention, the rotation is limited to no more than 20 degrees. In a more preferred embodiment, the rotation is limited to no more than 10 degrees. In a most preferred embodiment, the rotation is limited to no more than 5 degrees. The elastomeric end mounts 120 get stiffer or provide increasing torsional resistance (in a nonlinear manner) as the compressor 20 is twisted/rotated in the first axis. The gimbal formed by the resilient end mounts 120 made of an elastomeric material (e.g., plastic, rubber) provides for translational vibration isolation as well as rotational vibration isolation, although to a lesser degree.

The compressor vibration isolation mount 100 includes a substantially rectangular outer frame 210 that surrounds the inner frame 110 (and is substantially aligned therewith) and the compressor 20 (FIG. 5). The inner frame 110 is coupled to the outer frame 210 via a second pair of opposite end mounts 220. Through the end mounts 120, 220 and frames 110, 210, the weight of the compressor 20 is carried by the compressor vibration isolation mount 100.

Similar to the end mounts 120, each end mount 220 includes a cross-shaped member ("cross member") 230 formed of an elastomeric material (e.g., plastic, rubber), an outer/first pie-shaped wedge member 240, and an inner/second pie-shaped wedge member 250. The outer pie-shaped wedge member 240 attaches to the outer frame 210 and the inner pie-shaped wedge member 250 attaches to the inner frame 110. Each pie-shaped wedge member 240, 250 includes pie-shaped wedges and recesses. The cross member 230 and the wedges/recesses of the pie-shaped wedge members 240, 250 cooperate when these pieces are put together to form a resilient coupling between the outer frame 210 and the inner frame 110. The pie-shaped wedge members 240, 250 include corresponding holes for receiving fasteners used to couple the inner frame 110, end mounts 220, outer frame 210, and compressor housing/shroud (not shown) together.

The resilient nature and configuration of the end mounts 220 allows the inner frame 110 to rotate about a second axis substantially through the center of the end mounts 220 and substantially through the center of gravity of the compressor 20. The elastomeric material and configuration of the end mounts 220 keep the inner frame 110 from rotating about the second axis to no more than a few degrees. In an embodiment of the invention, the rotation is limited to no more than 20 degrees. In a more preferred embodiment, the rotation is limited to no more than 10 degrees. In a most preferred embodiment, the rotation is limited to no more than 5 degrees. The elastomeric end mounts 120 get stiffer or provide increasing torsional resistance (in a nonlinear manner) as the inner frame 110 is twisted/rotated in the second axis. The gimbal formed by the resilient end mounts 220 made of an elastomeric material (e.g., plastic, rubber) provides for translational vibration isolation as well as rotational vibration isolation, although to a lesser degree. The second axis is oriented substantially 90 degrees relative to the first axis. For each mount 120, 220, the flexibility of the mount 120, 220 may be easily adjusted by changing the durometer of the elastomeric material used in the mount 120, 220.

In an alternative embodiment, one or more of the frames 110, 210 partially surround the compressor 20 instead of completely surrounding the compressor 20.

In a further embodiment, the frame(s) may be (or be part of) the compressor housing, the structure housing, or other system/component housing.

Although the compressor vibration isolation mount 100 has been described as including a set of two gimbals, one mounted on the other with orthogonal pivot axes that extends extend substantially through the center of gravity of the compressor 20, in an alternative embodiment, the compressor vibration isolation mount 100 includes one gimbal that surrounds the compressor 20 and attaches substantially along one primary axis of rotation. In further embodiment, the compressor vibration isolation mount 100 includes other numbers of gimbals (e.g., 3, 4, etc.) Thus, the compressor vibration isolation mount 100 includes at least one gimbal that surrounds the compressor 20 and attaches substantially along at least one primary axis of rotation.

The compressor vibration isolation mount 100 will now be described in use. The compressor 20 is connected to the compressor vibration isolation mount 100, and the compressor vibration isolation mount 100 is connected to the compressor housing/shroud (not shown). In the embodiment shown in FIG. 5, the compressor 20 is a 180 degree opposed piston compressor. The compressor 20 includes a crankcase with an exterior side wall with opposite side mounts that the inner frame 110 is coupled to via the end mounts 120. The inner pie-shaped wedge members 150 of the end mounts 120 abuts the side mounts of the crankcase. The inner frame 110 surrounds the crankcase and motor of the compressor 20.

When the compressor 20 is mounted to the inner frame 110, the compressor is able to partially rotate relative to the inner frame 110 about the first axis. The inner frame 110 is coupled to, and surrounded by (and is substantially aligned therewith), the outer frame 210 via the second pair of opposite end mounts 220. The inner frame 110 (and compressor) is able to partially rotate relative to the outer frame 210 about the second axis.

Accordingly, the compressor vibration isolation mount 100 forms a set of two gimbals, one mounted on the other with pivot axes orthogonal and extending substantially through the center of gravity of the compressor 20. During operation of the compressor 20, the gimbal end mounts 120, 220 isolate the compressor 20 and reduce the transmitted vibration from the compressor 20 to the housing/shroud. The end mounts 120, 220 allow the compressor 20 to rotate/pivot slightly along two separate perpendicular axes. The elastomeric end mounts 120, 130 get stiffer or provide increasing torsional resistance (in a nonlinear manner) as the compressor 20 rotates/pivots relative to the inner frame 110 and/or as the inner frame 110 rotates/pivots relative to the outer frame 210. In a most preferred embodiment, the compressor 20/inner frame 110 only rotates up to a few degrees. The elastomeric material of the end mounts 120, 220 allow for translational vibration isolation in addition to rotational vibration isolation.

Therefore, the compressor vibration isolation mount 100 provides a simple, inexpensive, easy way to provide vibration isolation for the compressor, reduce the space required by a compressor vibration isolation system, and reduce the potential for the compressor 20 to knock against the inside of the compressor housing while it is being moved, in particular for a portable device such as, but not limited to, a portable oxygen concentrator. This reduces excessive noise in the concentrator, and prevents possible damage or wear to the compressor and hoses.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. A compressor vibration isolation mount for isolating the vibrations of a compressor from the rest of a structure, comprising:

at least one frame, the at least one frame including an inner frame and an outer frame; and at least one gimbal coupling the compressor to the at least one frame for partial rotation about at least one primary axis of rotation, wherein the at least one gimbal includes at least one gimbal end mount having a cross member, an inner pie-shaped wedge member, and an outer pie-shape wedge member, the cross member being contained in between the inner pie-shaped wedge member and the outer pie-shape wedge member, wherein the at least one gimbal end mount includes a first pair of opposite gimbal end mounts coupling the compressor to the inner frame for partial rotation about a first axis of rotation, and a second pair of opposite gimbal end mounts coupling the inner frame to the outer frame for partial rotation about a second axis of rotation.

2. The compressor vibration isolation mount of claim 1, wherein the at least one gimbal at least partially surrounds the compressor and attaches substantially along the at least one primary axis of rotation.

3. The compressor vibration isolation mount of claim 1, wherein the at least one gimbal includes two gimbals, one mounted on the other with orthogonal axes of rotation that extend substantially through a center of gravity of the compressor.

4. The compressor vibration isolation mount of claim 1, wherein the first axis of rotation and the second axis of rotation are orthogonal and extend substantially through a center of gravity of the compressor.

5. The compressor vibration isolation mount of claim 1, wherein the partial rotation is less than 20 degrees.

6. The compressor vibration isolation mount of claim 1, wherein the partial rotation is less than 10 degrees.

7. The compressor vibration isolation mount of claim 1, wherein the partial rotation is less than 5 degrees.

8. The compressor vibration isolation mount of claim 1, wherein the at least one gimbal is made of an elastomeric material and provides translational vibration isolation in addition to rotational vibration isolation.

9. The compressor vibration isolation mount of claim 1, wherein the at least one gimbal is made of an elastomeric material and provides increasing torsional resistance in a nonlinear manner as the compressor rotates relative to the at least one frame.

10. The compressor vibration isolation mount of claim 1, wherein the compressor is part of a pressure swing adsorption concentrator.

11. The compressor vibration isolation mount of claim 10, wherein the pressure swing adsorption concentrator is a portable oxygen concentrator.

12. The compressor vibration isolation mount of claim 1, wherein the compressor is a rotary piston air compressor.

13. The compressor vibration isolation mount of claim 1, wherein the compressor is a diaphragm-type air compressor.

14. A method of using a compressor vibration isolation mount, comprising:

providing a compressor with the compressor vibration isolation mount comprising at least one frame and at least one gimbal, the at least one gimbal coupling the compressor to the at least one frame for partial rotation about at least one primary axis of rotation; and operating the compressor so that the compressor vibrates and rotates partially about the at least one primary axis of rotation, wherein the at least one gimbal includes two gimbals, one mounted on the other with orthogonal axes of rotation that extend substantially through a center of gravity of the compressor, the at least one frame includes an inner frame and an outer frame, and the at least one gimbal includes a first pair of opposite gimbal end mounts coupling the compressor to the inner frame for partial rotation about a first axis of rotation, and a second pair of opposite gimbal end mounts coupling the inner frame to the outer frame for partial rotation about a second axis of rotation.

15. The method of claim 14, wherein operating the compressor includes operating the compressor so that the compressor vibrates and rotates partially about both orthogonal axes of rotation.

16. The method of claim 14, wherein the partial rotations are less than 20 degrees.

17. The method of claim 14, wherein the at least one gimbal is made of an elastomeric material, the at least one gimbal providing translational vibration isolation and rotational vibration isolation.

18. The method of claim 14, wherein the at least one gimbal is made of an elastomeric material and provides increasing torsional resistance in a nonlinear manner as the compressor rotates relative to the at least one frame.

19. The method of claim 14, wherein the compressor is a part of a pressure swing adsorption concentrator.

20. The method of claim 14, wherein the compressor is one of a rotary piston air compressor and a diaphragm-type air compressor.

* * * * *